US009580980B2

(12) United States Patent
Hartley et al.

(10) Patent No.: US 9,580,980 B2
(45) Date of Patent: Feb. 28, 2017

(54) TUBING HANGER RUNNING TOOL SYSTEM AND METHOD

(71) Applicant: Cameron International Corporation, Houston, TX (US)

(72) Inventors: David Hartley, South Yorkshire (GB); Alan Appleyard, North Humberside (GB); Ted Thornburrow, West Yorkshire (GB); Paul Hesketh, North Yorkshire (GB)

(73) Assignee: Cameron International Corporation, Houston, TX (US)

( * ) Notice: Subject to any disclaimer, the term of this patent is extended or adjusted under 35 U.S.C. 154(b) by 361 days.

(21) Appl. No.: 14/196,996

(22) Filed: Mar. 4, 2014

(65) Prior Publication Data

US 2015/0252635 A1 Sep. 10, 2015

(51) Int. Cl.

| | |
|---|---|
| ***E21B 19/16*** | (2006.01) |
| ***E21B 17/042*** | (2006.01) |
| ***E21B 33/04*** | (2006.01) |
| ***E21B 23/00*** | (2006.01) |
| ***E21B 33/03*** | (2006.01) |

(52) U.S. Cl.
CPC ..... *E21B 19/16* (2013.01); *E21B 17/042* (2013.01); *E21B 23/00* (2013.01); *E21B 33/03* (2013.01); *E21B 33/0415* (2013.01)

(58) Field of Classification Search
CPC ..... E21B 19/16; E21B 17/042; E21B 23/00; E21B 33/03; E21B 33/0415
See application file for complete search history.

(56) References Cited

U.S. PATENT DOCUMENTS

| | | | |
|---|---|---|---|
| 2011/0247798 | A1 | 10/2011 | June |
| 2012/0285678 | A1 | 11/2012 | Thornburrow et al. |

FOREIGN PATENT DOCUMENTS

| | | |
|---|---|---|
| EP | 0535277 A1 | 4/1993 |
| GB | 2150173 A | 6/1985 |
| GB | 2342668 A | 4/2000 |

OTHER PUBLICATIONS

ISR & WO for PCT/US2015/014670, mailed Jun. 1, 2015.

*Primary Examiner* — Yong-Suk (Philip) Ro
(74) *Attorney, Agent, or Firm* — Fletcher Yoder P.C.

(57) ABSTRACT

A system including a tubing hanger running tool (THRT), including one or more stab connectors, and a planetary gear system, wherein the planetary gear system is configured to couple and uncouple the THRT from a first hydrocarbon extraction component.

25 Claims, 7 Drawing Sheets

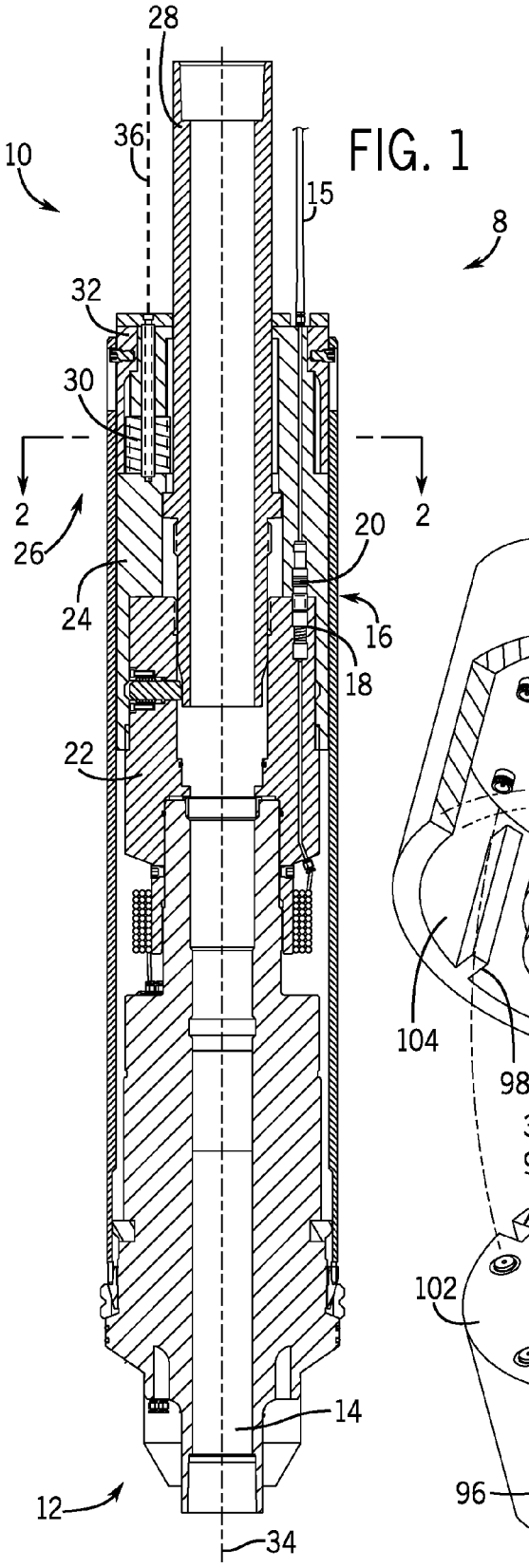
FIG. 1
FIG. 3
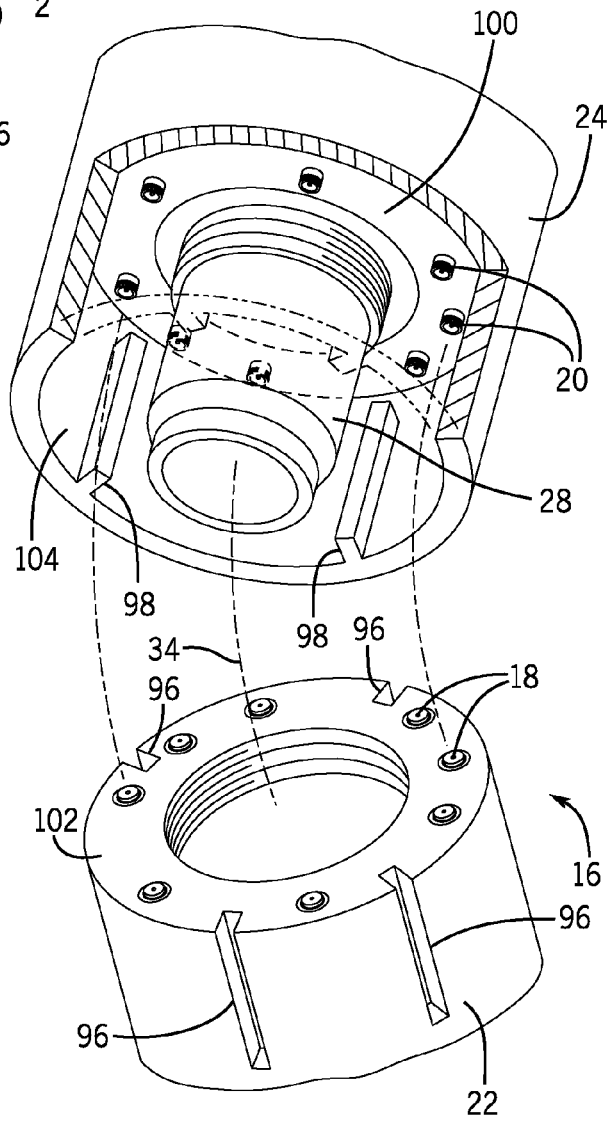

TUBING HANGER RUNNING TOOL SYSTEM AND METHOD

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In some drilling and production systems, hangers, such as a tubing hanger, may be used to suspend strings of tubing for various flows in and out of the well. Such hangers may be disposed within a wellhead that supports both the hanger and the string. For example, a tubing hanger may be lowered into a wellhead and supported there. To facilitate the running or lowering process, the tubing hanger may couple to a tubing hanger running tool (THRT). Once the tubing hanger has been lowered into a landed position within the wellhead by the THRT, the tubing hanger may then be mechanically locked into position. The THRT may then be disconnected from the tubing hanger and extracted from the wellhead.

Throughout the process of locking the hanger to the wellhead, down hole components may need to be activated and controlled to prevent any sudden pressure release from the well. This is achieved by controlling valves with hydraulic control lines that pass through the THRT and the tubing hanger. However, because the THRT rotatingly locks the hanger in place there is a break in the continuous control lines that prevents the control lines from rotating and breaking. Existing THRTs typically use a control line bushing that incorporates a series of seal galleries that maintain communication between control lines in the tubing hanger and control lines in the THRT, during rotation of the THRT. Unfortunately, as the THRT rotates the seals around the seal galleries may bunch and buckle.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 1 is a cross-sectional view of an embodiment of a tubing hanger running tool (THRT) coupled to a tubing hanger system;

FIG. 3 is an exploded perspective cutaway view of an embodiment of the THRT and the control line bushing with stab connectors;

DETAILED DESCRIPTION OF SPECIFIC EMBODIMENTS

Figure 2:
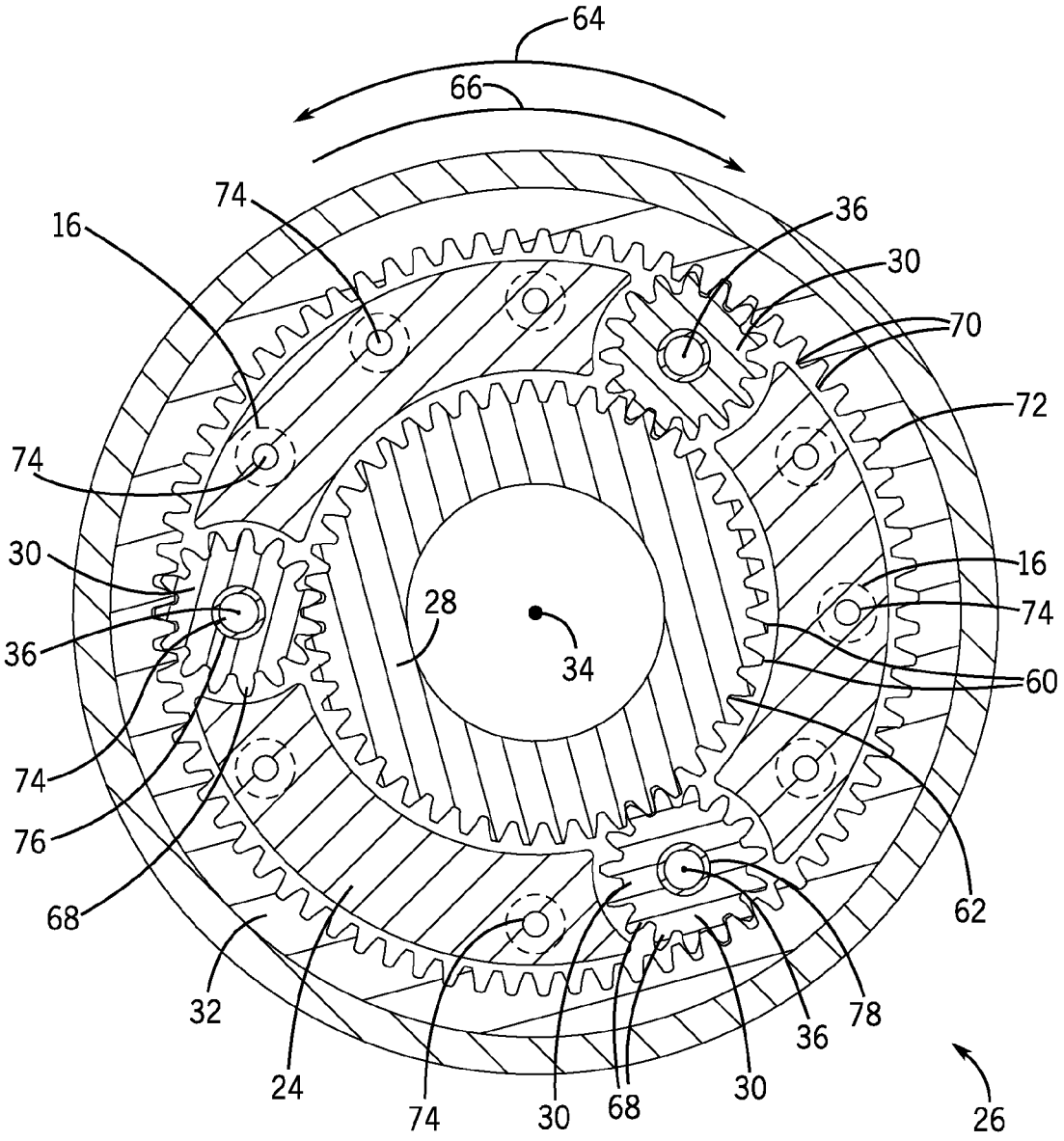
FIG. 2 is a cross-sectional view of an embodiment of a planetary gear system within the THRT.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a tubing hanger running tool system (THRT) that fluidly couples to a tubing hanger system with stab connectors. Specifically, the THRT includes a planetary gear system that enables the THRT to include a stationary carrier with stab connects while simultaneously including rotating components that install and remove the tubing hanger system. The stab connectors provide a reliable fluid connection for transferring hydraulic pressure to down hole components during insertion and removal of the tubing hanger system. Moreover, the stab connectors enable individualized hydraulic control of down hole components that may operate with different hydraulic pressures or with different hydraulic fluids. The THRT thereby increases the reliability of down hole component control while installing and removing a tubing hanger system.

FIG. 1 is a cross-sectional view of a hydrocarbon extraction system 8 with a tubing hanger running tool system (THRT) 10 coupled to a tubing hanger system 12. During hydrocarbon extraction operations, the tubing hanger system 12 is used to suspend a string of tubing (e.g., piping) in a central bore 14 enabling various flows in and out of the well. The tubing hanger system 12 may be disposed within a wellhead (seen in FIG. 9) that supports both the tubing hanger system 12 and the string. The tubing hanger system 12 is lowered and retrieved from the wellhead using the THRT 10. During the running or lowering process, the tubing hanger system 12 couples to the THRT 10. Once the tubing hanger system 12 has been lowered into a landed position within the wellhead, the tubing hanger system 12 may be mechanically locked into position. The THRT 10 may then be uncoupled from the tubing hanger system 12 and extracted from the wellhead.

During the process of running the tubing hanger system 12 within the wellhead, various down hole components (e.g., safety valves) may need to be activated and controlled. These components are controlled using hydraulic pressure in fluid lines 15 that extend from a surface vessel or platform to the THRT 10. The THRT 10 transfers the hydraulic pressure to the down hole components by fluidly coupling to the tubing hanger system 12 via a control line bushing 22 that is pre-fitted to the top of the tubing hanger system 12. As illustrated, the control line bushing 22 couples to a carrier 24 of the THRT 10 with stab connectors 16. The stab connectors 16 include a male portion 18 in a control line bushing 22 of the tubing hanger system 12 and a female portion 20 in a carrier 24 of the THRT 10. When coupled, the male and female portions 18, 20 form the fluid connection between the THRT 10 and the tubing hanger system 12. To ensure that the female stab connectors 20 in the carrier 24 are correctly align with the male stab connectors 18 in the control line bushing 22, the carrier 24 and control line bushing 22 include castellations (i.e., grooves or recesses 96, and projections 98 seen in FIG. 3). As illustrated in FIG. 3, the castellations 96 and 98 align the carrier 24 and the control line bushing 22 while simultaneously blocking rotation of the carrier 24 relative to the control line bushing 22.

FIG. 2 is a cross-sectional view of the planetary gear system 26 within the THRT system 10. In operation, the planetary gear system 26 enables the THRT 10 to fluidly couple to the tubing hanger system 12 with stab connectors 16 while simultaneously enabling THRT 10 components to rotate, which mechanically couple and uncouple the tubing hanger system 12 from a wellhead. The planetary gear system 26 includes a mandrel 28 (e.g., a sun gear), two or more planetary gears 30, and an outer ring 32 (e.g., an outer gear). As illustrated, the mandrel 28 includes gear teeth 60 on an outer surface 62 that enable the mandrel 28 to operate as the sun gear in the planetary gear system 26. As the mandrel 28 rotates in either rotational direction 64 or 66 about the axis 34, the gear teeth 60 engage the gear teeth 68 on the planetary gears 30, which enable the planetary gears 30 to rotate. However, the planetary gears 30 do not rotate about the axis 34, because they are coupled to the carrier 24. As explained above, the castellations 96, 98 (seen in FIG. 3) block rotation of the carrier 24, and therefore rotation of the planetary gears 30 about the axis 34. Instead, the planetary gears 30 rotate about their own axes 36 in the opposite direction of the mandrel 28. As the planetary gears 36 rotate, the planetary gear teeth 68 engage the gear teeth 70 on the outer ring 32, which rotate the outer ring 32 in the same direction as the planetary gears 30 (i.e., in the direction opposite the mandrel 28). In this arrangement, the planetary gear system 26 enables the THRT 10 to have a stationary carrier 24 (i.e., the carrier 24 does not rotate about the axis 34) that supports stab connectors 16. As illustrated, the carrier 24 includes multiple control lines 74. Each of the control lines 74 supports a separate stab connector 16 that enables electrical, gas, or fluid communication with down hole components. For example, the THRT 10 may support multiple down hole devices with different hydraulic pressure requirements and different types of hydraulic fluids. In the present embodiment, there are eight control lines 74. However, in another embodiment, there may be 1, 2, 3, 4, 5, 6, 7, 8, 9, 10, or more control lines 74 that support different stab connectors 16. In some embodiments, the planetary gears 30 may support additional control lines 74. For example, the planetary gears 30 may include an aperture 76 that receives a hollow bearing 78. The hollow bearing 78 enables rotation of the planetary gears 30 while supporting additional control lines 74.

FIG. 3 is an exploded perspective cutaway view of the THRT 10 and the control line bushing 22. As illustrated, the carrier 24 and control line bushing 22 include castellations 96 and 98 (i.e., alignment/anti-rotation features) that ensure the female stab connectors 20 in the carrier 24 correctly align with the male stab connectors 18 in the control line bushing 22. In the present embodiment, the carrier 24 includes the female portions 20 of the stab connectors 16 on a carrier face 100, while the control line bushing 22 includes the male portions 18 on a landing face 102. However, in some embodiments, the carrier 24 may include the male portions 18 and the control line bushing 22 may include the female portions 20. In still other embodiments, the carrier 24 may include male portions 18 and female portions 20 that correspond with respective female portions 20 and male portions 18 on the control line bushing 22. When lowered, the carrier 24 receives the control line bushing 22 within a counterbore 104 enabling the carrier face 100 to contact and rest on the landing face 102 of the control line bushing 22. The contact between the landing face 102 and the carrier face 100 couples the male and female portions 18, 20 of the stab connectors 16 creating hydraulic communication between the THRT 10 and the tubing hanger system 12. The hydraulic communication enables hydraulic control of down hole components during installation and removal of the tubing hanger system 12.

Figure 4:
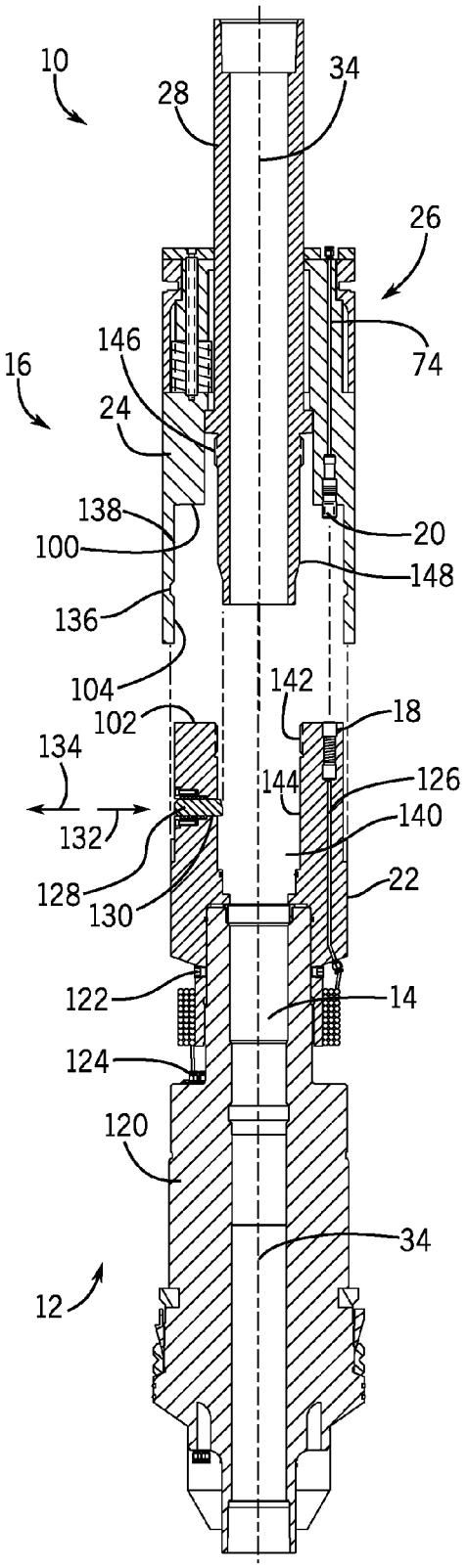
FIG. 4 is a cross-sectional view of an embodiment of the tubing hanger system separated from the THRT.

FIG. 4 is a cross-sectional view of an embodiment of the tubing hanger system 12 separated from the THRT 10. As illustrated, the tubing hanger system 12 includes the control line bushing 22 coupled to the tubing hanger 120. More specifically, the control line bushing 22 threads onto the tubing hanger 120 and is held in place with two anti-rotation pins 122. When coupled, control lines 124 in the tubing hanger 120 fluidly communicate with control lines 126 in the control line bushing 22. The control line bushing 22 enables the tubing hanger system 12 to couple both mechanically and fluidly to the THRT 10. As explained above, the control line bushing 22 includes male portions 18 of the stab connectors 16 that fluidly couple to the female portions 20 of the stab connectors 16 on the carrier 24. When the male and female portions 18, 20 fluidly couple, hydraulic pressure moves through control lines 74 in the carrier 24 and into control lines 126 in the control line bushing 22, enabling individualized hydraulic control of down hole components. In order to mechanically couple to the THRT 10, the control line bushing 22 includes one or more radial dogs 128 (e.g., pins) in an aperture 130. The radial dogs 128 extend and retract in radial directions 132 and 134 to engage and disengage a groove 136 along an interior surface 138 of the counterbore 104. For example, as the radial dogs 128 extend in radial direction 134, the dogs 128 engage the groove 136 on the carrier 24, which couples the THRT 10 to the tubing hanger system 12. Similarly, when the radial dogs 128 move in radial direction 132, the dogs 128 uncouple the carrier 24 from the control line bushing 22. In some embodiments, the mandrel 28 may form a second connection between the THRT 10 and the tubing hanger system 12. For example, the bore 140 of the control line bushing 22 may include a threaded portion 142 along the interior surface 144 that couples to a threaded portion 146 on an exterior surface 148 of the mandrel 28.

Figure 5:
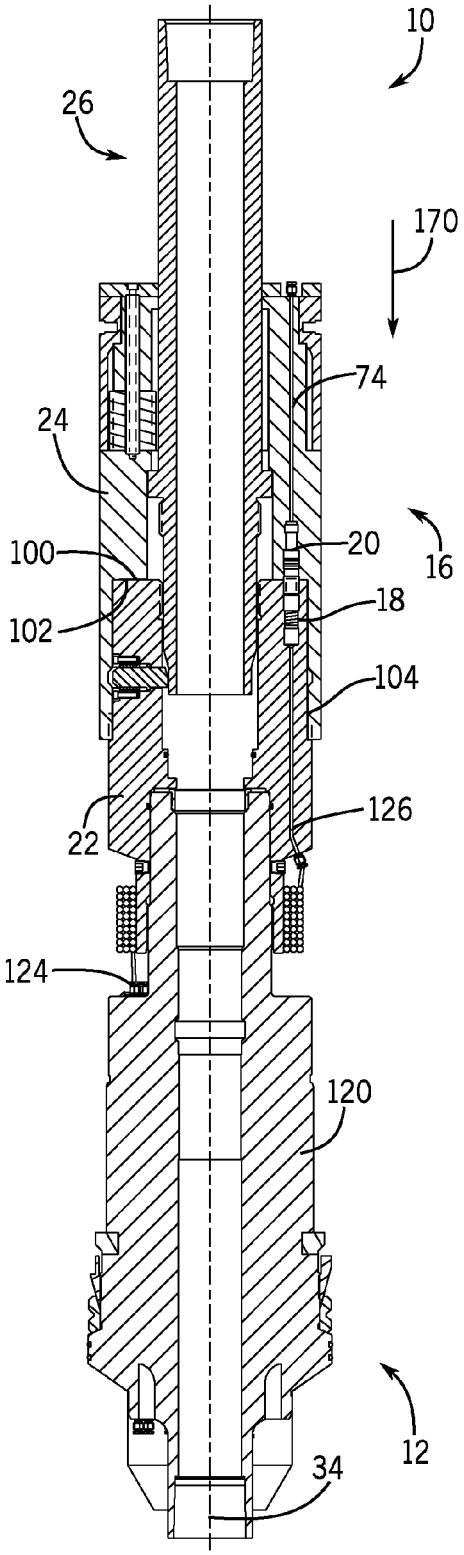
FIG. 5 is a cross-sectional view of an embodiment of the THRT carrier in a landed position on the control line bushing of the tubing hanger system.

FIG. 5 is a cross-sectional view of the THRT carrier 24 landed on the control line bushing 22 of the tubing hanger system 12. More specifically, as the THRT 10 moves in axial direction 170, the carrier 24 receives the control line bushing 22 within the counterbore 104. The THRT 10 will continue to move in axial direction 170 until the carrier face 100 of the carrier 24 contacts the landing face 102 on the control line bushing 22. In this position, the male and female portions 18, 20 of the stab connector 16 engage one another and form a fluid connection between the fluid control lines 74 and 126 within the respective carrier 24 and the control line bushing 22.

Figure 6:
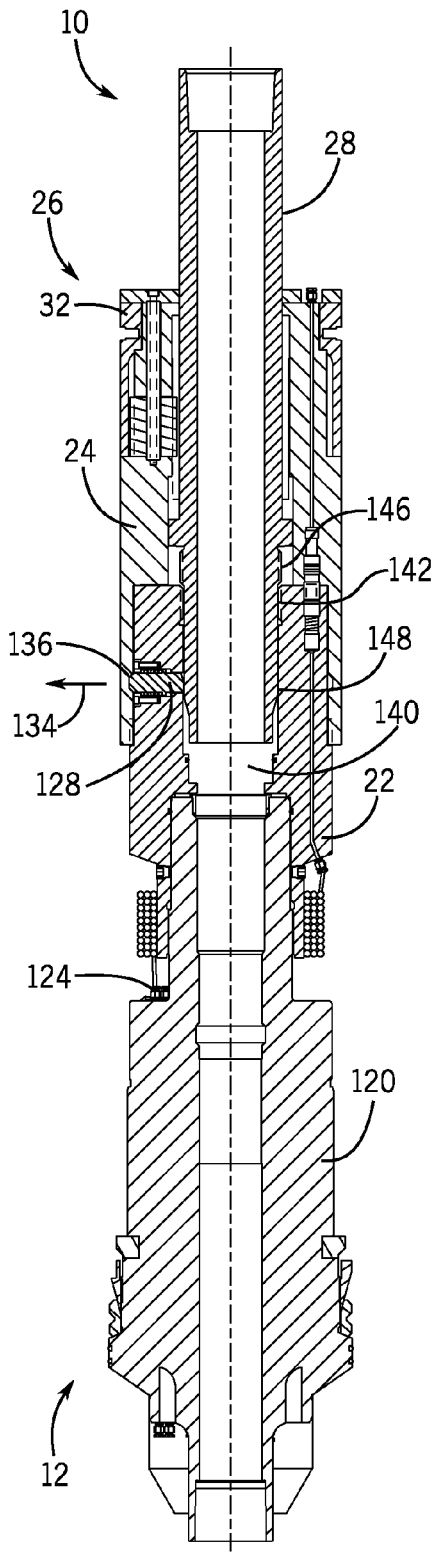
FIG. 6 is a cross-sectional view of an embodiment of the radial dogs of the control line bushing coupled to the THRT carrier.

FIG. 6 is a cross-sectional view of the radial dog 128 of the control line bushing 22 coupled to the carrier 24. After landing the carrier 24 on top of the control line bushing 22, the mandrel 28 continues to move axially into the bore 140 of the control line bushing 22. As the mandrel 28 moves in axial direction 170, the exterior surface 148 of the mandrel 28 contacts the radial dog 128 and drives the radial dog 128 in radial direction 134 and into the groove 136 of the carrier 24. In this position, the radial dog 128 couples THRT 10 to the tubing hanger system 12.

Figure 7:
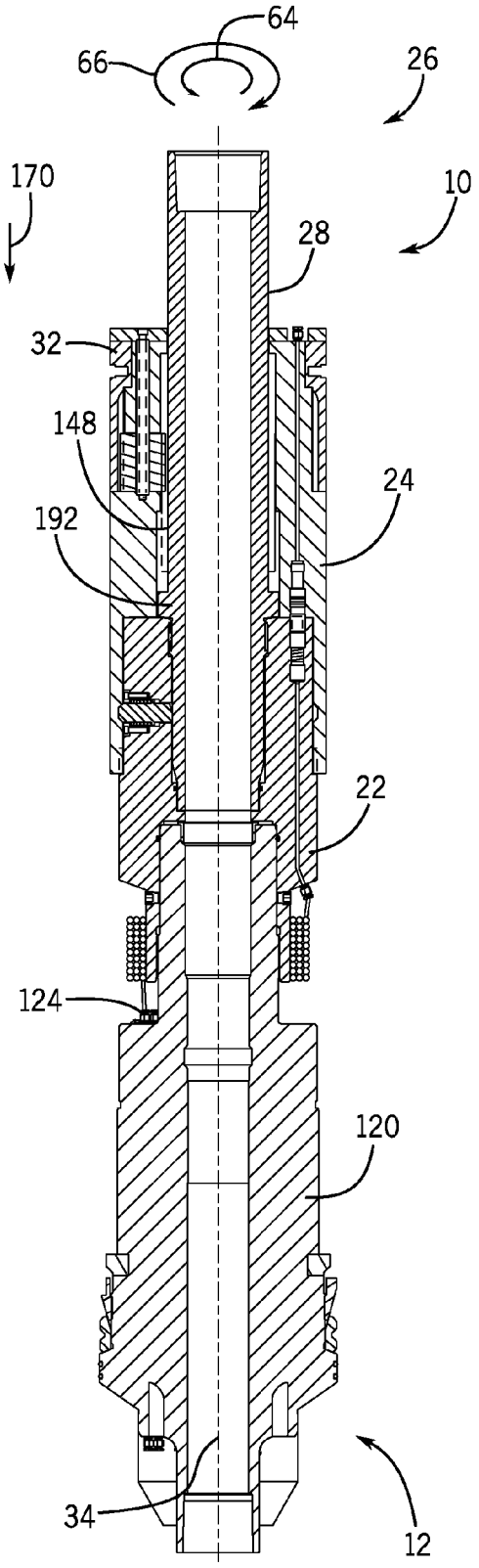
FIG. 7 is a cross-sectional view of an embodiment of the THRT mandrel threading into the control line bushing.

FIG. 7 is a cross-sectional view of the mandrel 28 threading into the control line bushing 22. After moving the mandrel 28 in axial direction 170, the threaded portion 146 on the mandrel 28 will contact the threaded portion 142 on the control line bushing 22. In order to continue moving the mandrel 28 in the axial direction 170, the mandrel 28 circumferentially rotates in counterclockwise direction 64 about the axis 34. The rotation of the mandrel 28 threads the threaded portion 146 of the mandrel 28 into the threaded portion 142 of the control line bushing 22. The mandrel 28 continues to thread into the control line bushing 22 until a flange 192 on the outer surface 148 contacts the landing face 102 of the control line bushing 22. In this position, the THRT 10 is mechanically and fluidly coupled to the tubing hanger system 12.

Figure 8:
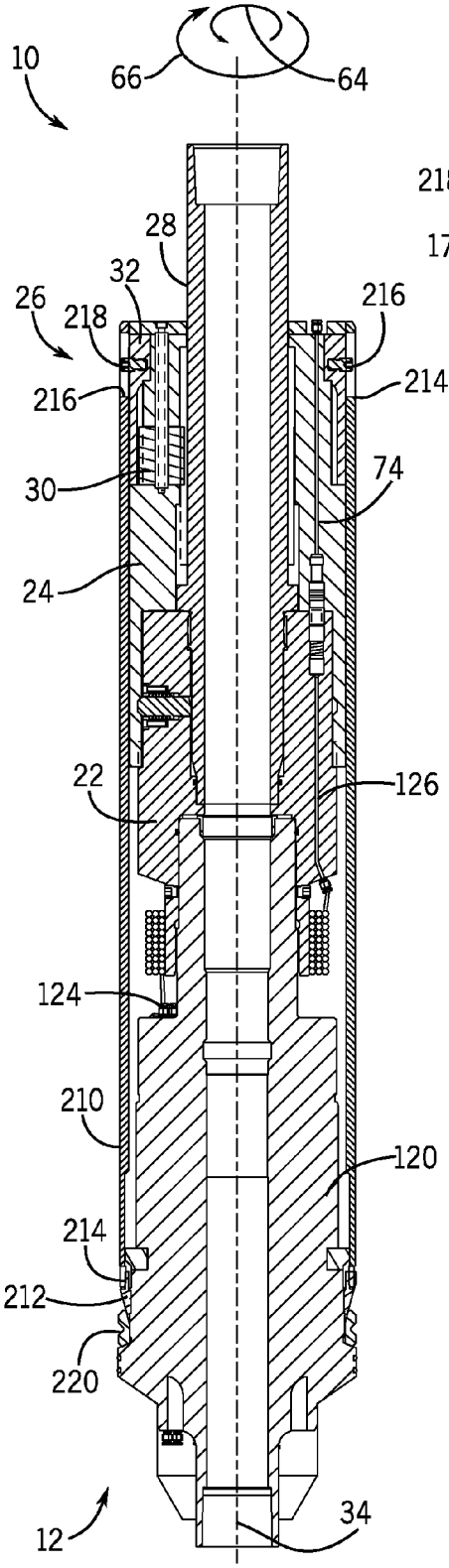
FIG. 8 is a cross-sectional view of an embodiment of the outer sleeve coupling to the THRT.

FIG. 8 is a cross-sectional view of an outer sleeve 210 coupled to the outer ring 32. As illustrated, the outer sleeve 210 surrounds the carrier 24 and extends over the control line bushing 22 before coupling to an energizing ring 212 with shear pins 214. On the opposite end, the outer sleeve 210 includes apertures 216 that enable torque pins 218 to couple to the outer ring 32. In operation, as the outer ring 32 rotates, the torque pins 218 engage the outer sleeve 210 forcing the outer sleeve 210 to rotate with the outer ring 32. Furthermore, rotation of the outer ring 32 enables rotation of the energizing ring 212 through the shear pins 214 that couple the energizing ring 212 to the outer sleeve 210.

Figure 9:
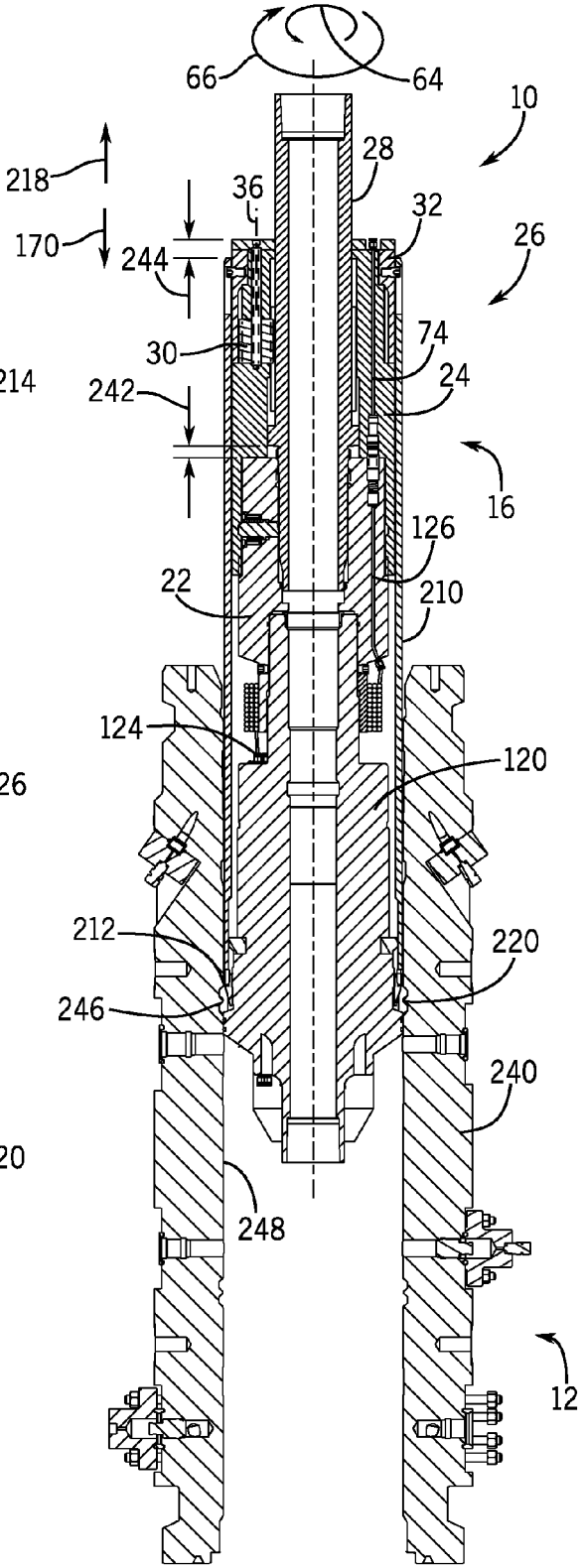
FIG. 9 is a cross-sectional view of an embodiment of the THRT inserting the tubing hanger system into a wellhead.

FIG. 9 is a cross-sectional view of the THRT 10 inserting the tubing hanger system 12 into a wellhead 240. After lowering the tubing hanger system 12 into the wellhead 240, the THRT 10 uses the planetary gear system 26 to mechanically couple the tubing hanger system 12 to the wellhead 240. In order to couple the THRT 10 to the wellhead 240, the THRT 10 rotates the mandrel 28 (e.g., the sun gear) in either direction 64 or 66. As the mandrel 28 rotates it engages the planetary gears 30, which in turn engage the outer ring 32. As the mandrel 28 and outer ring 32 rotate, the mandrel 28 partially unthreads from the control line bushing 22 a distance 242 in direction 218, while the energizing ring 212 moves a distance 244 in axial direction 170. More specifically, rotation of the outer ring 32 rotates the outer sleeve 210, which then rotates the energizing ring 212 via the shear pins 214. As illustrated, the energizing ring 212 threads onto the outer surface of the tubing hanger 120. Accordingly, when the energizing ring 212 rotates the energizing ring 212 moves in axial direction 170. As the energizing ring 212 moves in direction 170 the energizing ring 212 drives the lockdown ring 220 radially outward and into the groove 246 on the interior surface 248 of the wellhead 240, which couples the tubing hanger 120 to the wellhead 240. During this process the carrier 24 is held stationary enabling the stab connectors 16 to maintain hydraulic communication with down hole components.

Figure 10:
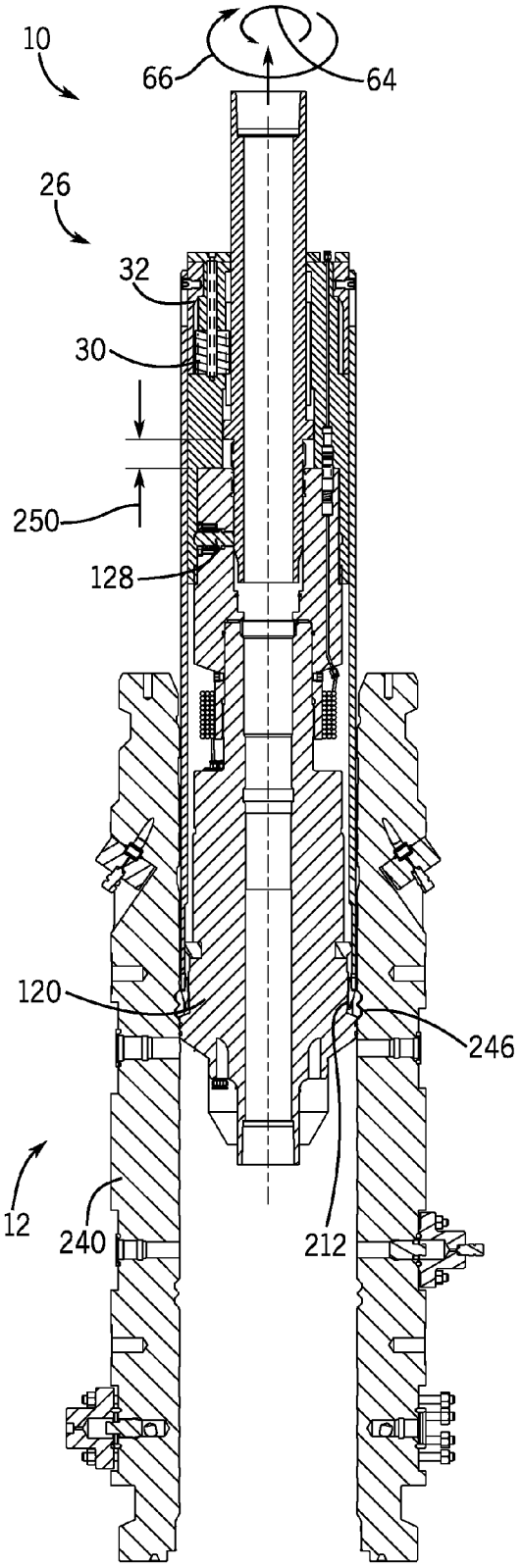
FIG. 10 is a cross-sectional view of an embodiment of the lockdown ring engaging the wellhead to couple the tubing hanger system to the wellhead.

FIG. 10 is a cross-sectional view of a THRT 10 disengaging from the tubing hanger system 12. Once the lockdown ring 220 couples to the wellhead groove 246, the outer ring 32 continues to rotate enabling the outer sleeve 210 to shear through the shear pins 214. After shearing through the shear pins 214, the outer sleeve 210 freely rotates about the energizing ring 212 enabling the mandrel 28 to continue rotating in the opposite direction, until the mandrel 28 completely unthreads itself from the control line bushing 22 a distance 250.

Figure 11:
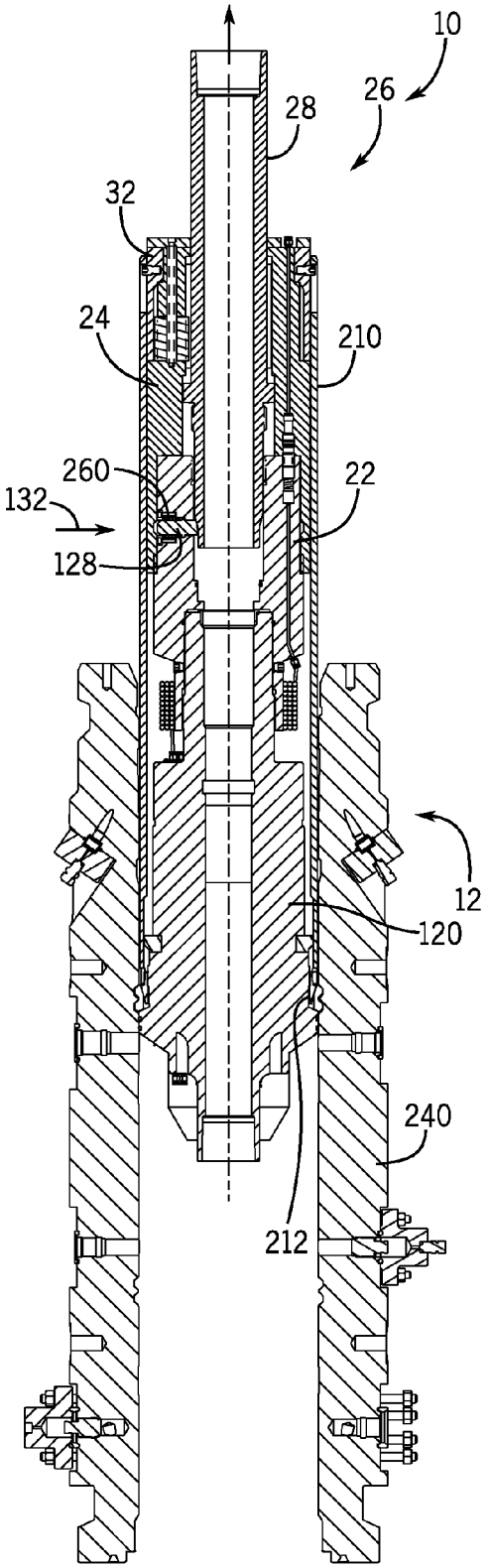
FIG. 11 is a cross-sectional view of an embodiment of the radial dogs retracting from the THRT carrier.

FIG. 11 is a cross-sectional view of an embodiment of the radial dogs 128 retracting from the THRT carrier 24. After completely unthreading the mandrel 28 from the control line bushing 22, the THRT 10 may stop rotating the outer ring 32 and the mandrel 28. The THRT 10 may then axially retract the mandrel 28 in direction 218. As the mandrel 28 retracts, the mandrel 28 uncovers the radial dogs 128 enabling a spring 260 to move the radial dogs 128 in direction 132. Once the radial dogs 128 retract from the carrier groove 136, the THRT 10 is able to separate from the tubing hanger system 12.

Figure 12:
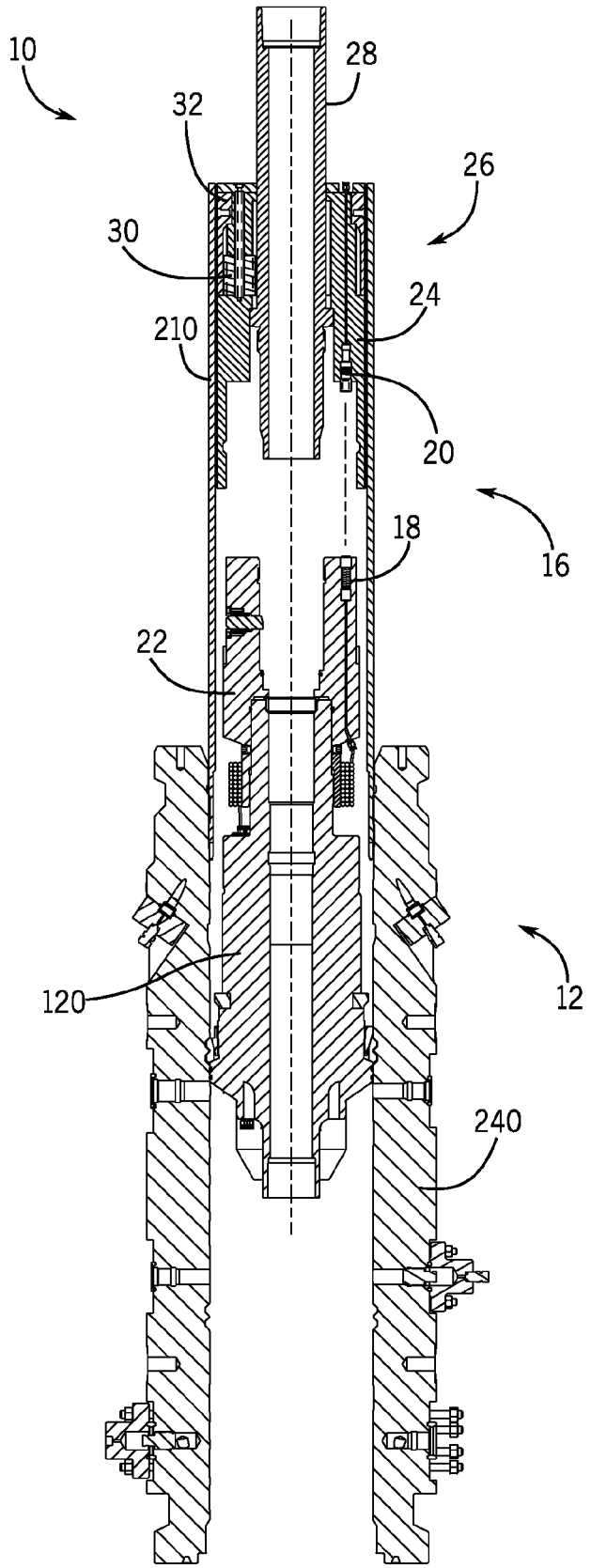
FIG. 12 is a cross-sectional view of the THRT separating from the tubing hanger system.

FIG. 12 is a cross-sectional view of the THRT 10 separating from the tubing hanger system 12. After separating, the THRT 10 is withdrawn to the surface enabling use of the tubing hanger system 12 for drilling operations.

Technical effects of the disclosed embodiments of the invention include a THRT and tubing hanger system that uses stab connectors along with a planetary gear system to provide hydraulic communication to down hole components while enabling the THRT to rotate during installation of the tubing hanger. The stab connectors provide a reliable fluid connection for transferring hydraulic pressure to down hole components during insertion and removal of the tubing hanger system. Moreover, the stab connectors enable individualized hydraulic control of down hole components that may operate with different hydraulic pressures or with different hydraulic fluids. The THRT thereby increases the reliability of down hole component control during the installation and removal of a tubing hanger system.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a running tool, comprising:

one or more stab connectors; and a planetary gear system comprising a sun gear, an outer gear, and one or more planetary gears disposed between the sun gear and the outer gear, wherein the running tool is configured to couple a first mineral extraction component to a second mineral extraction component by rotating the sun gear and the outer gear in opposite directions, while simultaneously blocking rotation of the one or more planetary gears around the sun gear.

2. The system of claim 1, wherein each of the one or more stab connectors has an axis radially offset from a central axis of the sun gear.

3. The system of claim 2, comprising a carrier coupled to the one or more planetary gears and the one or more stab connectors.

4. The system of claim 3, wherein the running tool is configured to couple the one or more stab connectors with one or more mating stab connectors of a control line bushing of the first mineral extraction component.

5. The system of claim 4, comprising a mandrel having the sun gear, wherein the running tool is configured to thread a threaded portion of the mandrel with a mating threaded portion of the first mineral extraction component.

6. The system of claim 3, wherein the one or more stab connectors are configured to support electrical, gas, and/or fluid communication.

7. The system of claim 3, wherein at least one of the one or more planetary gears comprises a hollow bearing, and the hollow bearing is configured to receive a line coupled to at least one of the one or more stab connectors.

8. The system of claim 1, wherein the first mineral extraction component comprises a hanger.

9. The system of claim 8, wherein the second mineral extraction system comprises a wellhead.

10. The system of claim 1, wherein the running tool is configured to couple with the first mineral extraction component by rotating the sun gear and the outer gear in opposite directions, while simultaneously blocking rotation of the one or more planetary gears around the sun gear.

11. The system of claim 1, wherein the running tool is configured to disengage a first coupling between the running tool and the first mineral extraction component while simultaneously engaging a second coupling between the first and second mineral extraction components via rotation of the planetary gear system.

12. The system of claim 11, wherein the first coupling comprises a threaded coupling between a threaded portion of the sun gear and a mating threaded portion of the first mineral extraction component, and the second coupling is actuated by rotation of the outer gear.

13. The system of claim 12, wherein the second coupling comprises a radial lock actuated by rotation of an energizing ring coupled to the outer gear, the energizing ring has a shear pin configured to shear after the running tool actuates the radial lock via the rotation of the planetary gear system, and the running tool is configured to continue disengaging the threaded coupling after shearing of the shear pin.

14. The system of claim 1, comprising an outer sleeve coupled to the outer gear, wherein the outer gear is configured to rotate the outer sleeve enabling the outer sleeve to move axially.

15. A system comprising:

a tubing hanger comprising one or more first stab connector portions;

a tubing hanger running tool (THRT) configured to couple to a tubing hanger, the THRT comprises:

a planetary gear system comprising a sun gear, an outer gear, and one or more planetary gears disposed between the sun gear and the outer gear, wherein the planetary gear system is configured to couple and uncouple the tubing hanger from a wellhead; and one or more second stab connector portions configured to couple with the one or more first stab connector portions to provide fluid communication between the THRT and the tubing hanger, wherein the one or more first and second stab connector portions have axes radially offset from a central axis of the sun gear.

16. The system of claim 15, wherein the THRT is configured to couple or uncouple the tubing hanger with the wellhead by rotating the sun gear and the outer gear in opposite directions, while simultaneously blocking rotation of the one or more planetary gears around the sun gear.

17. The system of claim 15, wherein the THRT is configured to couple with the tubing hanger by rotating the sun gear and the outer gear in opposite directions, while simultaneously blocking rotation of the one or more planetary gears around the sun gear.

18. The system of claim 15, comprising a carrier coupled to the one or more planetary gears and the one or more first stab connector portions, wherein THRT is configured to block rotation of the carrier during rotation of the planetary gear system.

19. The system of claim 15, comprising an outer sleeve coupled to the outer gear, wherein the outer gear is configured to rotate the outer sleeve enabling the outer sleeve to move axially.

20. The system of claim 19, wherein rotation of the outer sleeve enables the outer sleeve to rotate an energizing ring that energizes a lockdown ring to lock the tubing hanger to the wellhead.

21. The system of claim 19, wherein the outer sleeve couples to the energizing ring with one or more shear pins.

22. A method, comprising:

coupling a running tool with a first mineral extraction system to couple a first stab connector portion to a second stab connector portion, wherein the running tool comprises a planetary gear system having a sun gear, an outer gear, and one or more planetary gears disposed between the sun gear and the outer gear; and coupling the first mineral extraction system with a second mineral extraction system by rotating the sun gear and the outer gear in opposite directions, while simultaneously blocking rotation of the one or more planetary gears around the sun gear.

23. The method of claim 22, wherein coupling the running tool with the first mineral extraction component comprises rotating the sun gear and the outer gear in opposite directions, while simultaneously blocking rotation of the one or more planetary gears around the sun gear.

24. The method of claim 22, comprising blocking rotation of a carrier coupled to the one or more planetary gears and the first stab connector portion, wherein axes of the first and second stab connector portions are radially offset from a central axis of the sun gear.

25. The method of claim 22, comprising disengage a first coupling between the running tool and the first mineral extraction component while simultaneously engaging a second coupling between the first and second mineral extraction components via rotation of the planetary gear system.

* * * * *